US006517323B2

(12) United States Patent
Kimura et al.

(10) Patent No.: US 6,517,323 B2
(45) Date of Patent: Feb. 11, 2003

(54) DISPLACEMENT CONTROL MECHANISM FOR VARIABLE DISPLACEMENT TYPE COMPRESSOR

(75) Inventors: Kazuya Kimura, Kariya (JP); Satoshi Umemura, Kariya (JP); Izuru Shimizu, Kariya (JP); Taku Adaniya, Kariya (JP); Kazuhiko Minami, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 18 days.

(21) Appl. No.: 09/900,258

(22) Filed: Jul. 6, 2001

(65) Prior Publication Data

US 2002/0006337 A1 Jan. 17, 2002

(30) Foreign Application Priority Data

Jul. 7, 2000 (JP) ..... 2000-206879

(51) Int. Cl.[7] ..... F04B 1/26
(52) U.S. Cl. ..... 417/222.2; 62/228.5; 62/228.3
(58) Field of Search ..... 417/222.2; 62/228.5, 62/228.3

(56) References Cited

U.S. PATENT DOCUMENTS 5,681,150 A * 10/1997 Kawaguchi et al. ..... 417/222.2
6,164,925 A 12/2000 Yokomachi et al. ..... 417/222.2
6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al. ..... 9/900

FOREIGN PATENT DOCUMENTS

JP 2000-9044 1/2000 ..... F04B/49/06

* cited by examiner

*Primary Examiner*—Charles G. Freay
*Assistant Examiner*—W Rodriguez
(74) *Attorney, Agent, or Firm*—Morgan & Finnegan, LLP

(57) ABSTRACT

A displacement control mechanism used for compressor is installed in a refrigerant circuit. The compressor has a bleed passage and a supply passage. The displacement control mechanism includes a first control valve and a second control valve. The first control valve includes a first valve body and a pressure sensitive member. The first valve body adjusts the opening size of the supply passage. The pressure sensitive member moves in accordance with a pressure in the refrigerant circuit. A pressure detection region is located downstream of the first valve body. The second control valve includes a second valve body. The second valve body adjusts the opening size of the bleed passage. The second valve body moves in accordance with the pressure of the pressure detection region. When the pressure of the pressure detection region increases, the second control valve decreases the opening size of the bleed passage. This permits to start with rapid cooling performance.

13 Claims, 12 Drawing Sheets

DISPLACEMENT CONTROL MECHANISM FOR VARIABLE DISPLACEMENT TYPE COMPRESSOR

BACKGROUND OF THE INVENTION

The present invention relates to a displacement control mechanism incorporated in a refrigerant circuit of an air-conditioning system for controlling the discharge displacement of a variable displacement type compressor, in which can change the discharge displacement varies in accordance with the pressure in the crank chamber.

In general, a displacement control mechanism includes a supply passage for connecting a crank chamber of a variable displacement type compressor with a discharge pressure region, a bleed passage for connecting the crank chamber with a suction pressure region, and a control valve for controlling the degree of opening the supply passage. The control valve controls the degree of opening the supply passage, i.e., the flow rate of refrigerant gas flowing into the crank chamber. For example, the discharge displacement of the compressor decreases as the pressure in the crank chamber increases. Conversely, the discharge displacement increases as the pressure in the crank chamber decreases.

When controlling the pressure in the crank chamber by controlling the discharge displacement of the compressor through regulation of the supply passage, as compared with controlling the discharge displacement of the compressor by controlling through regulation of the bleed passage, the discharge displacement of the compressor can be changed more rapidly since the gas in the supply passage has a higher pressure. Thus, the cooling performance of the associated air-conditioning system is improved.

For example, when the compressor is started with the refrigerant in a liquid state in the crank chamber, the liquid refrigerant in the crank chamber is discharged into the suction pressure region through the bleed passage in a liquid state and/or in an evaporated state due to, for example, a rising ambient temperature.

When changing the discharge displacement by controlling the degree of opening of the supply passage, however, a fixed restrictor is provided in the bleed passage for reducing the flow rate of the compressed refrigerant gas flowing into the suction pressure region. Therefore, upon starting the compressor, the discharge of the liquid refrigerant from the crank chamber through the bleed passage is relatively slow. As a result, a considerable part of the liquid refrigerant may be evaporated in the crank chamber, which may excessively increase in the pressure in the crank chamber. This extends the time from when the control valve closes the supply passage until the discharge displacement of the compressor starts to increase. In other words, cooling is delayed.

BRIEF SUMMARY OF THE INVENTION

It is an object of the present invention to provide a displacement control mechanism for variable displacement type compressors wherein air-conditioning systems can be started with rapid cooling performance.

To attain the above object, the present invention provides a displacement control mechanism used for a variable displacement type compressor. The displacement of which varies in accordance with the pressure of a crank chamber. The control mechanism is installed in a refrigerant circuit. The refrigerant circuit includes a suction pressure zone and a discharge pressure zone. The compressor has a bleed passage, which connects the crank chamber to the suction pressure zone, and a supply passage, which connects the crank chamber to the discharge pressure zone. One of the bleed passage and the supply passage is a control passage that connects the crank chamber to a zone in which the pressure is different from the pressure of the crank chamber. The other is a regulating passage. The displacement control mechanism comprises a first control valve and a second control valve. The first control valve comprises a first valve body for adjusting the opening size of the control passage. A pressure sensitive member moves in accordance with a pressure in the refrigerant circuit such that the displacement is varied to counter changes of the pressure in the refrigerant circuit. A pressure detection region is located in the control passage. The pressure detection region is located downstream of the first valve body. The second control valve includes a second valve body for adjusting the opening size of the regulating passage. The second valve body moves in accordance with the pressure of the pressure detection region. When the pressure of the pressure detection region increases, the second control valve decreases the opening size of the control passage.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
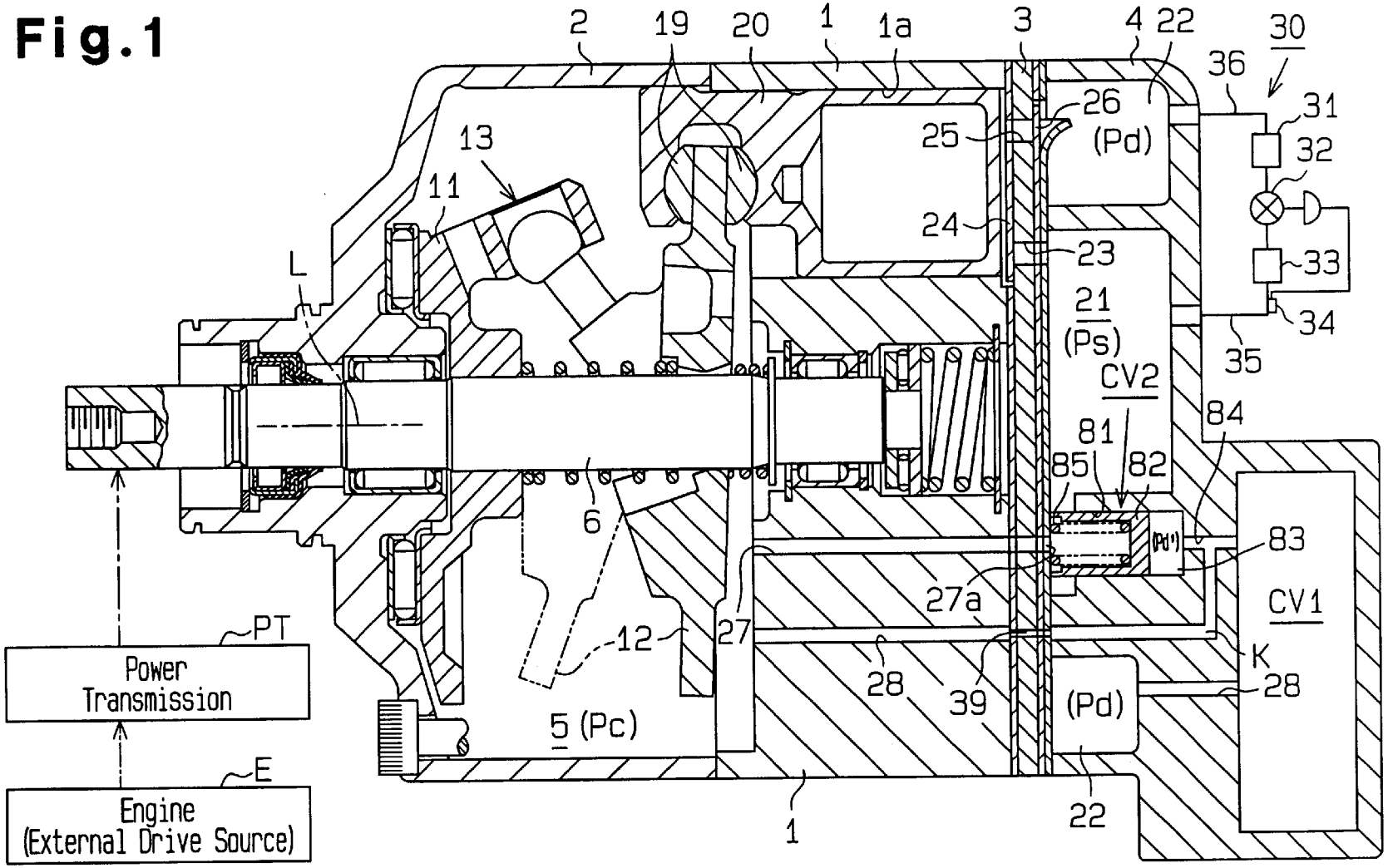
FIG. 1 is a sectional view of a variable displacement type swash plate compressor according to a first embodiment of the present invention.

In the first to tenth embodiments, the present invention is applied to a displacement control mechanism for variable displacement type swash plate compressors used in vehicular air-conditioning systems. In the second to tenth embodiments, only features different from those of the first embodiment will be described, and the same or corresponding components are denoted by the same reference numerals.

As shown in FIG. 1, a variable displacement type swash plate compressor includes a cylinder block 1, a front housing member 2 joined to the front end of the cylinder block 1, a rear housing member 4 joined to the rear end of the cylinder block 1, and a valve plate 3 between the cylinder block 1 and the rear housing member 4. The cylinder block 1 and the front and rear housing members 2 and 4 form a compressor housing.

A crank chamber 5 is defined between the cylinder block 1 and the front housing 2. In the crank chamber 5, a drive shaft 6 is supported. In the crank chamber 5, a lug plate 11 is fixed to the drive shaft 6 to rotate together with the drive shaft 6.

The front end of the drive shaft 6 is connected through a power transmission PT with a vehicular engine E. The power transmission PT may be a clutch mechanism (e.g., an electromagnetic clutch), which can transmit or interrupt power according to an external electric control. Alternatively, the transmission may be a clutchless mechanism (e.g. a combination of belt/pulley), that includes no such clutch mechanism and always transmits power. In this embodiment, a clutchless type power transmission is employed.

The crank chamber 5 accommodates a swash plate 12, or a drive plate. The swash plate 12 is supported on the drive shaft 6 so that the swash plate 12 can slide along and incline relative to the drive shaft 6. A hinge mechanism 13 is provided between the lug plate 11 and the swash plate 12. The swash plate 12 is connected with the lug plate 11 and the drive shaft 6 through the hinge mechanism 13. The swash plate 12 can be rotated synchronously with the lug plate 11 and the drive shaft 6.

In the cylinder block 1, a plurality of cylinder bores 1*a* (only one of them is shown in FIG. 1) are formed at constant angular intervals around the axis L of the drive shaft 6. Each cylinder bore 1*a* accommodates a single-headed piston 20 so that the piston 20 can reciprocate in the cylinder bore 1*a*. In each cylinder bore 1*a*, a compression chamber is defined whose volume changes in accordance with the reciprocation of the piston 20. An end portion of each piston 20 is linked to a peripheral portion of the swash plate 12 through a pair of shoes 19. Through this linkage, the rotation of the swash plate 12 is converted into reciprocation of the pistons 20 in accordance with the inclination angle of the swash plate 12.

Between the valve plate 3 and the rear housing 4, a suction chamber 21 and a discharge chamber 22 surrounding the suction chamber 21 are defined. For each cylinder bore 1*a*, the valve plate 3 is provided with a suction port 23, a suction valve 24 for opening and closing the suction port 23, a discharge port 25, and a discharge valve 26 for opening and closing the discharge port 25. Each cylinder bore 1*a* communicates with the suction chamber 21 through the corresponding suction port 23 and with the discharge chamber 22 through the corresponding discharge port 25.

When each piston 20 moves from its top dead center position to its bottom dead center position, refrigerant gas in the suction chamber 21 flows into the corresponding cylinder bore 1*a* through the corresponding suction port 23 and suction valve 24. When each piston 20 moves from its bottom dead center toward its top dead center, the refrigerant gas in the corresponding cylinder bore 1*a* is compressed to a predetermined pressure. The refrigerant gas forces the corresponding discharge valve 26 to open, and the gas is discharged into the discharge chamber 22.

The inclination angle of the swash plate 12 (the angle between a plane perpendicular to the axis of the drive shaft 6 and the swash plate 12) is determined on the basis of various moments, such as the moment of rotation caused by centrifugal force upon the swash plate 12, the moment of inertia upon each piston 20, and the moment of gas pressure. The moment of gas pressure depends on the relationship between the pressure in each cylinder bore 1*a* and the crank pressure Pc. The moment of gas pressure increases or decreases the inclination angle of the swash plate 12 in accordance with the magnitude of the crank pressure Pc.

In this embodiment, a displacement control mechanism controls the crank pressure Pc to change the gas pressure moment. The inclination angle of the swash plate 12 can thus be changed between the minimum inclination angle (as shown by solid lines in FIG. 1) and the maximum inclination angle (as shown by the dashed line in FIG. 1).

The displacement control mechanism includes a bleed passage 27, a supply passage 28, a first control valve CV1, and a second control valve CV2, all of which are provided in the housing of the compressor shown in FIG. 1. The bleed passage 27 connects the crank chamber 5 with the suction chamber 21, which is a suction pressure region. The second control valve CV2 is located in the bleed passage 27. The supply passage 28 connects the crank chamber 5 with the discharge chamber 22, which is a discharge pressure Pd region. The first control valve CV1 is located in the supply passage 28. The supply passage 28 includes a fixed restrictor 39, which is formed by the valve plate 3. One of the bleed passage 27 and the supply passage 28 is a control passage and the other is a regulating passage.

By controlling the degree of opening of the first and second control valves CV1 and CV2, the balance between the flow rate of high-pressure gas flowing into the crank chamber 5 through the supply passage 28 and the flow rate of gas flowing out of the crank chamber 5 through the bleed passage 27 is controlled to determine the crank pressure Pc. In accordance with a change in the crank pressure Pc, the difference between the crank pressure Pc and the pressure in each cylinder bore 1*a* is changed to change the inclination angle of the swash plate 12. As a result, the stroke of each piston 20, i.e., the discharge displacement, is controlled.

Figure 2:
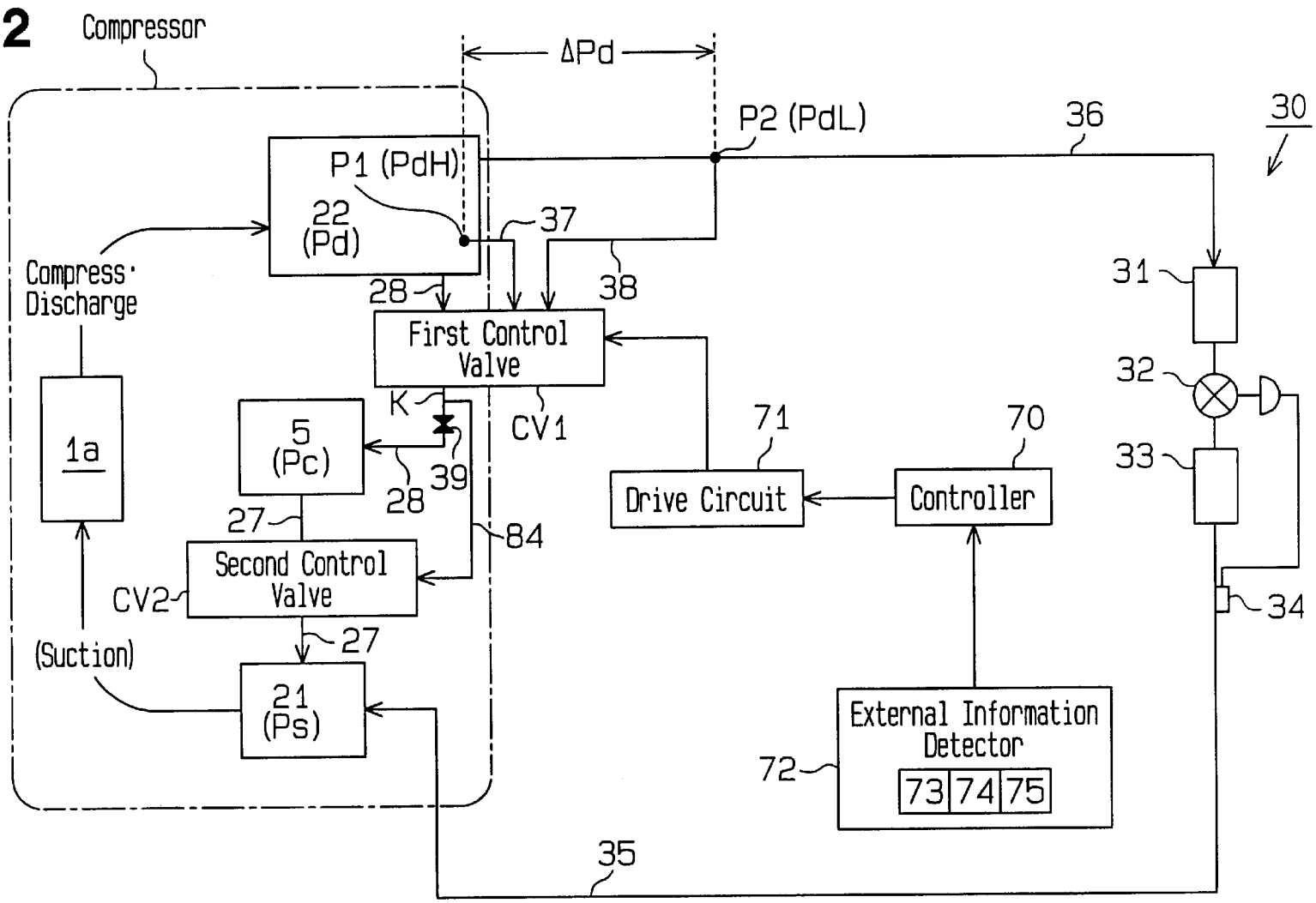
FIG. 2 is a circuit diagram showing a refrigerant circuit according to the first embodiment.

As shown in FIGS. 1 and 2, the refrigerant circuit of the vehicular air-conditioning system is made up of the compressor and an external refrigerant circuit 30. The external refrigerant circuit 30 includes, for example, a condenser 31, an expansion valve 32, and an evaporator 33. The expansion valve 32 and the evaporator 33 constitute a depressurizing system. The degree of opening the expansion valve 32 is feed-back controlled on the basis of the temperature detected by a temperature-sensing tube 34, which is provided near the outlet of the evaporator 33, and the evaporation pressure (the pressure near the outlet of the evaporator 33). The expansion valve 32 sends to the evaporator 33 a quantity of liquid refrigerant corresponding to the thermal load and controls the flow rate of the refrigerant in the external refrigerant circuit 30.

In the external refrigerant circuit 30, a first conducting pipe 35 is provided downstream of the evaporator 33 to connect the outlet of the evaporator 33 with the suction chamber 21 of the compressor. In the external refrigerant circuit 30, a second conducting pipe 36 is provided the upstream of the condenser 31 to connect the inlet of the condenser 31 with the discharge chamber 22 of the compressor. The compressor draws refrigerant gas into the suction chamber 21 from the downstream end of the external refrigerant circuit 30 and compresses it. The compressor then discharges the compressed gas to the upstream end of the external refrigerant circuit 30 through the discharge chamber 22.

The greater the flow rate of the refrigerant flowing in the refrigerant circuit is, the greater the pressure loss per unit length of the circuit or piping is. That is, the pressure loss (pressure difference) in the region between two pressure-monitoring points P1 and P2 provided in the refrigerant circuit has a positive correlation with the flow rate of the refrigerant in the circuit. Therefore, by detecting the pressure difference ΔPd between the two pressure-monitoring points P1 and P2, the flow rate of the refrigerant in the refrigerant circuit can be detected indirectly.

In this embodiment, the first pressure-monitoring point P1 is provided in the discharge chamber 22, and the second pressure-monitoring point P2 is provided in the second conducting pipe 36 at a predetermined distance from the first pressure-monitoring point P1. The pressure PdH at the first pressure-monitoring point P1 is applied to the first control valve CV1 through a first pressure detection passage 37, and the pressure PdL at the second pressure-monitoring point P2 is applied to the first control valve CV1 through a second pressure detection passage 38.

Figure 3:
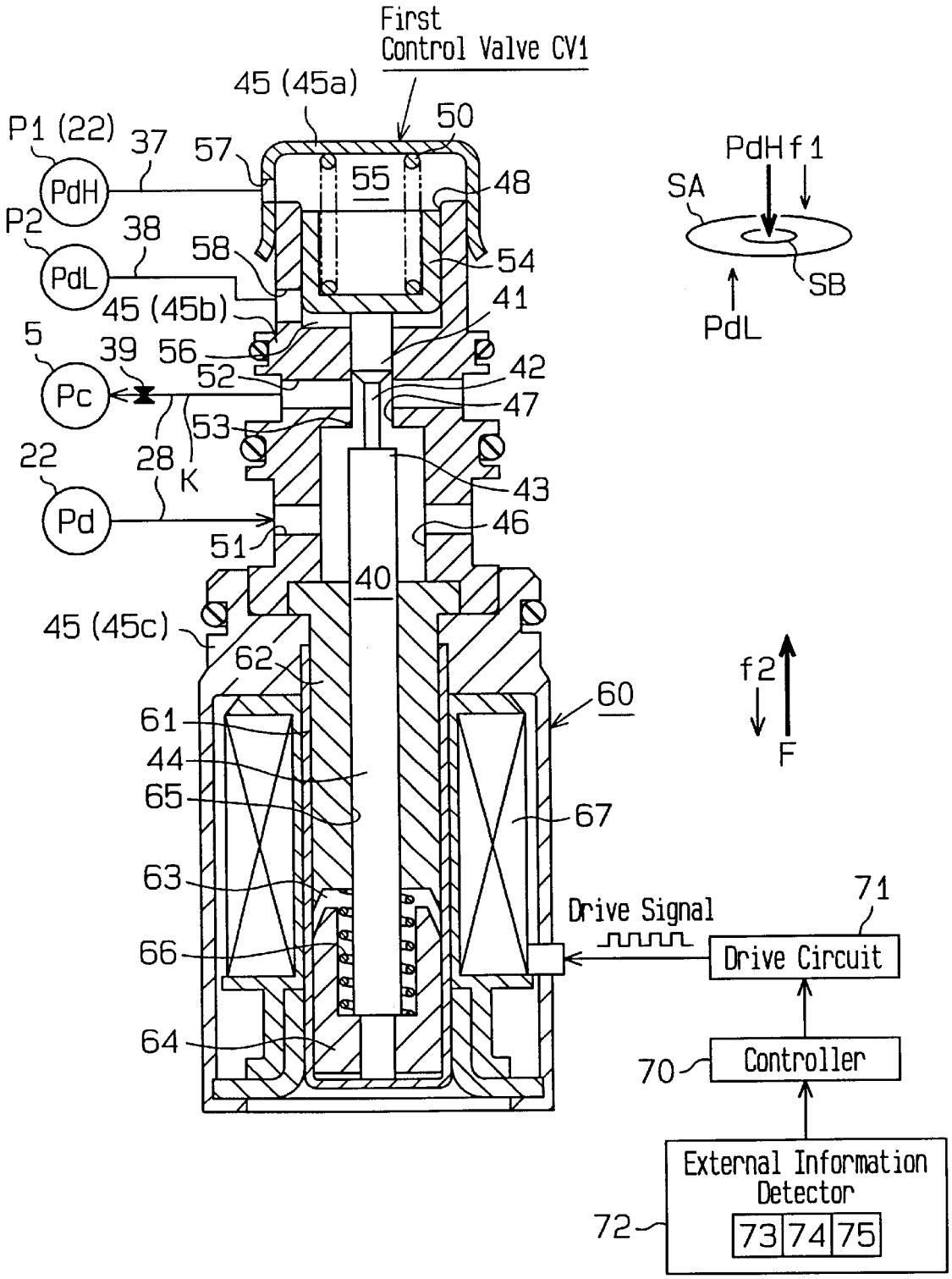
FIG. 3 is a sectional view of a first control valve provided in the compressor of FIG. 1.

Referring to FIG. 3, the first control valve CV1 includes an inlet-side valve portion and a solenoid portion 60. The inlet-side valve portion controls the degree of opening the supply passage 28 connecting the discharge chamber 22 with the crank chamber 5. The solenoid portion 60 serves as an electromagnetic actuator for controlling an operation rod 40 provided in the first control valve CV1 on the basis of the level of an externally supplied current. The operation rod 40 has a distal end portion 41, a valve body portion 43, a connecting portion 42, which joins the distal end portion 41 with the valve body portion 43, and a guide portion 44. The valve body portion 43 is part of the guide portion 44.

A valve housing 45 of the first control valve CV1 includes a cap 45*a*, an upper-half body 45*b*, and a lower-half body 45*c*. A valve chamber 46 and a communication passage 47 are defined in the upper-half body 45*b*. A pressure-sensing chamber 48 is defined between the upper-half body 45*b* and the cap 45*a*.

In the valve chamber 46 and the communication passage 47, the operation rod 40 moves axially. The valve chamber 46 communicates with the communication passage 47 selectively in accordance with the position of the operation rod 40. The communication passage 47 is isolated from the pressure-sensing chamber 48 by the distal end portion 41, which serves as part of the valve housing 45.

The upper end face of a fixed iron core 62 serves as the bottom wall of the valve chamber 46. A port 51 extending radially from the valve chamber 46 connects the valve chamber 46 with the discharge chamber 22 through an upstream part of the supply passage 28. A port 52 extending radially from the communication passage 47 connects the communication passage 47 with the crank chamber 5 through a downstream part of the supply passage 28. Thus, the port 51, the valve chamber 46, the communication passage 47, and the port 52 serve as part of the supply passage 28, which connects the discharge chamber 22 with the crank chamber 5 and serves as the control passage.

The valve body portion 43 of the operation rod 40 is located in the valve chamber 46. The inner diameter of the communication passage 47 is larger than the diameter of the connecting portion 42 of the operation rod 40 and smaller than the guide portion 44. That is, the cross-sectional area SB of the communication passage 47 (the cross-sectional area of the distal end portion 41 perpendicular to the axis) is larger than the cross-sectional area of the connecting portion 42 and smaller than the cross-sectional area of the guide portion 44. A valve seat 53 is formed around the opening portion of the communication passage 47.

When the operation rod 40 has moved from the position shown in FIG. 3 (the lowest position) to the uppermost position, at which the valve body portion 43 is in contact with the valve seat 53, the communication passage 47 is closed. The valve body portion 43 of the operation rod 40 serves as an inlet-side valve body (a first valve body) that can arbitrarily control the degree of opening of the supply passage 28.

A bottomed cylindrical first pressure-sensing member 54 is provided in the pressure-sensing chamber 48 and is movable axially. The first pressure-sensing member 54 axially divides the pressure-sensing chamber 48 into two, i.e., first and second, pressure chambers 55 and 56. The first pressure-sensing member 54 serves as a partition between the first and second pressure chambers 55 and 56 and interrupts communication between the chambers 55 and 56. The cross-sectional area SA of the first pressure-sensing member 54 is larger than the cross-sectional area SB of the communication passage 47.

The first pressure chamber 55 accommodates a first spring 50, which is a coil spring. The first spring 50 urges the first pressure-sensing member 54 toward the second pressure chamber 56.

The first pressure chamber 55 communicates with the discharge chamber 22, in which the first pressure-monitoring point P1 is located, through a first port 57 formed in the cap 45*a* and the first pressure detection passage 37. The second pressure chamber 56 is connected to the second pressure-monitoring point P2 through a second port 58, which is formed in the upper-half body 45*b* of the valve housing 45, and the second pressure detection passage 38. Thus, the pressure PdH at the first pressure-monitoring point P1 is applied to the first pressure chamber 55 and the pressure PdL at the second pressure-monitoring point P2 is applied to the second pressure chamber 56.

The solenoid portion 60 includes a bottomed cylindrical accommodation tube 61. A fixed iron core 62 is fitted in the accommodation tube 61. A solenoid chamber 63 is defined in the accommodation tube 61. The solenoid chamber 63 accommodates a movable iron core 64, which is movable axially. An axial guide hole 65 is formed at the center of the fixed iron core 62. In the guide hole 65, the guide portion 44 of the operation rod 40 is movable axially.

A proximal end of the operation rod 40 is accommodated in the solenoid chamber 63. A lower end of the guide portion 44 is fitted in a through hole formed at the center of the movable iron core 64, and the lower end is fixed to the movable iron core 64 by crimping. Thus, the movable iron core 64 is moved vertically together with the operation rod 40.

In the solenoid chamber 63, a second spring 66 of a coil spring is located between the fixed and movable iron cores 62 and 64. The second spring 66 urges the movable iron core 64 downward, i.e., separates the direction in which the movable iron core 64 separates from the fixed iron core 62.

A coil 67 is wound around the fixed and movable iron cores 62 and 64. The coil 67 is supplied with a drive signal from a drive circuit 71 based on instructions from a controller 70. The coil 67 generates an electromagnetic force F, the magnitude of which depends on the electric power supplied, between the fixed and movable iron cores 62 and 64. The electric current supplied to the coil 67 is controlled by controlling the voltage applied to the coil 67. In this embodiment, for the control of the applied voltage, a duty control is employed.

As shown in FIGS. 2 and 3, the vehicular air-conditioning system includes the above-mentioned controller 70. The controller 70 includes a CPU, a ROM, a RAM, and an I/O interface. An external information detector 72 is connected to an input terminal of the I/O interface, and the above-mentioned drive circuit 71 is connected to an output terminal of the I/O interface.

The controller 70 calculates an adequate duty ratio Dt on the basis of various external information provided from the external information detector 72 and instructs the drive circuit 71 to output a drive signal at the duty ratio Dt. The instructed drive circuit 71 then outputs the drive signal to the coil 67 of the first control valve CV1. The electromagnetic force F of the solenoid portion 60 of the first control valve CV1 changes in accordance with the duty ratio Dt of the drive signal supplied to the coil 67.

The external information detector 72 includes, for example, an A/C switch (an ON/OFF switch of the air-conditioning system to be operated by an occupant in the vehicle) 73, a temperature sensor 74 for detecting the temperature in the passenger compartment, and a temperature setting device 75 for setting the temperature in the passenger compartment.

Figure 4:
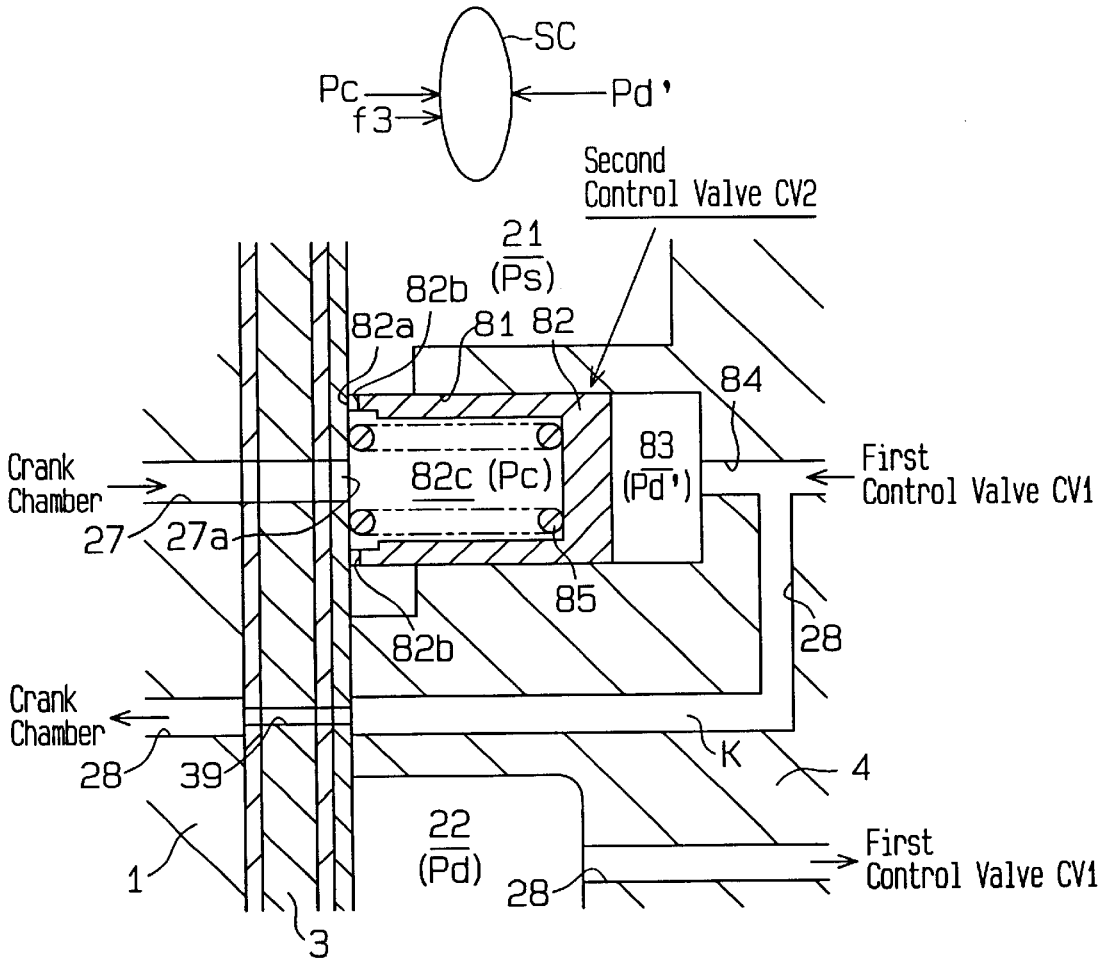
FIG. 4 is an enlarged sectional view of the vicinity of a second control valve provided in the compressor of FIG. 1.

As shown in FIGS. 1 and 4, an accommodation chamber 81 for supporting a bottomed cylindrical spool 82 is formed in the rear housing 4. The rear housing 4 serves as a valve housing for the second control valve CV2. The spool 82 is accommodated in the accommodation chamber 81 and is axially movable toward and away from the valve plate 3.

In the accommodation chamber 81, a back pressure chamber 83 is defined between a rear face of the spool 82 and the rear housing 4. A pressure detection passage 84 branches from the supply passage 28. The pressure detection passage 84 connects a pressure detection region K between the first control valve CV1 and the fixed restrictor 39 with the back pressure chamber 83. Thus, the pressure Pd' of the pressure detection region K in the supply passage 28 is applied to the back pressure chamber 83 through the pressure detection passage 84.

A third spring 85 is provided between the valve plate 3 and the spool 82. The third spring 85 urges the spool 82 from the valve plate 3. Thus, the position of the spool 82 relative to the valve plate 3 is determined by the force f3 of the third spring 85 and a force based on the crank pressure Pc in the bleed passage 27, both of which are directed rightward in FIG. 4, and a leftward force in FIG. 4 based on the pressure Pd' in the back pressure chamber 83. The spool 82 serves as a second pressure-sensing member that is displaced in accordance with the pressure Pd' of the pressure detection region K in the supply passage 28.

With regard to the spool 82, the effective pressure-receiving area for the pressure Pd' in the back pressure chamber 83 is equal to the effective pressure-receiving area for the crank pressure Pc (both are equal to the cross-sectional area SC of the spool 82). The third spring 85 applies a light load and has a low spring constant. Therefore, if the pressure Pd' in the back pressure chamber 83 exceeds the crank pressure Pc even slightly, an interruption face 82*a* of the spool 82 comes into contact with the valve plate 3.

The bleed passage 27 has an opening portion 27*a* that is open to a space 82*c* in the spool 82. The spool 82 serves as a second valve body that can control the degree of opening the bleed passage 27 in accordance with the displacement of the spool 82.

In the interruption face 82*a* of the spool 82, a groove 82*b* having a very small cross section is formed to extend radially. Thus, even when the interruption face 82*a* is in contact with the valve plate 3, the space 82*c* in the spool 82 communicates with the suction chamber 21 through the groove 82*b*.

In the first control valve CV1, the position of the operation rod 40 is determined as follows. Here, the effect of the pressure in the valve chamber 46, the pressure of communication passage 47, and the pressure in the solenoid chamber 63 on positioning of the operation rod 40 is ignored.

As shown in FIG. 3, when the coil 67 is supplied with no electric current, the downward force f1+f2 by the first and second springs 50 and 66 dominantly acts on the operation rod 40. Thus, the operation rod 40 is placed at its lowermost position, and the communication passage 47 is fully opened.

The crank pressure Pc is the maximum that is possible under the given conditions. The pressure difference between the crank pressure Pc and the pressure in each cylinder bore 1*a* thus becomes large. As a result, the inclination angle of the swash plate 12 is minimized, and the discharge displacement of the compressor is also the minimized.

When the coil 67 is supplied with an electric current having the minimum duty ratio or more within the variation range of the duty ratio Dt, the upward electromagnetic force F becomes greater than the downward force f1+f2 by the first and second springs 50 and 66, so that the operation rod 40 is moved upward. In this state, the upward electromagnetic force F, which has been offset by the downward force f2 of the second spring 66, opposes the downward force based on the pressure difference ΔPd, which adds to the downward force f1 of the first spring 50. Thus, the valve body portion 43 of the operation rod 40 is positioned relatively to the valve seat 53 so as to satisfy the following equation:

$$PdH \cdot SA - PdL(SA - SB) = F - f1 - f2.$$

For example, if the speed of the engine E decreases, which decreases the flow rate of the refrigerant in the refrigerant circuit, then the pressure difference ΔPd decreases and the electromagnetic force F at that time cannot keep the balance between the forces acting on the operation rod 40. As a result, the operation rod 40 moves upward to increase the downward force f1+f2 by the first and second springs 50 and 66. The valve body portion 43 of the operation rod 40 is then positioned so that the increase in the force f1+f2 can compensates for the decrease in the pressure difference ΔPd. As a result, the degree of opening of the communication passage 47 is decreased and the crank pressure Pc is decreased. Therefore, the pressure difference between the crank pressure Pc and the pressure in each cylinder bore 1*a* decreases. Thus, the inclination angle of the swash plate 12 is increased, which increases the discharge displacement of the compressor. When the discharge displacement of the compressor is increased, the flow rate of the refrigerant in the refrigerant circuit is also increased, which increases the pressure difference ΔPd.

Conversely, if the speed of the engine E increases and the flow rate of the refrigerant in the refrigerant circuit increases accordingly, then the pressure difference ΔPd increases and the electromagnetic force F at that time cannot keep the balance between the forces acting on the operation rod 40. As a result, the operation rod 40 moves downward and the valve body portion 43 of the operation rod 40 is positioned so that the decrease in the downward force f1+f2 by the first and second springs 50 and 66 compensates for the increase in the pressure difference ΔPd. As a result, the degree of opening of the communication passage 47 is increased, which increases the crank pressure Pc. Therefore, the pressure difference between the crank pressure Pc and the pressure in each cylinder bore 1*a* increases. Thus, the inclination angle of the swash plate 12 is decreased and the discharge displacement of the compressor is decreased accordingly. When the discharge displacement of the compressor is decreased, the flow rate of the refrigerant in the refrigerant circuit is also decreased, which decreases the pressure difference ΔPd.

For example, if the duty ratio Dt of the electric current supplied to the coil 67 is increased to increase the electromagnetic force F, the pressure difference ΔPd at that time cannot keep the balance between the upward and downward forces. As a result, the operation rod 40 moves upward and the valve body portion 43 of the operation rod 40 is positioned so that the increase in the downward force f1+f2 by the first and second springs 50 and 66 compensates for the increase in the upward electromagnetic force F. Therefore, the degree of opening of the communication passage 47 is decreased, which increases the discharge displacement of the compressor. Thus, the flow rate of the refrigerant in the refrigerant circuit is increased, which increases the pressure difference ΔPd.

On the other hand, if the duty ratio Dt of the electric current supplied to the coil 67 is decreased to decrease the electromagnetic force F, the pressure difference ΔPd at that time cannot keep the balance between the upward and downward forces. As a result, the operation rod 40 moves downward and the valve body portion 43 of the operation rod 40 is positioned so that the decrease in the downward force f1+f2 by the first and second springs 50 and 66 compensates for the decrease in the upward electromagnetic force F. Therefore, the degree of opening of the communication passage 47 is increased, which decreases the discharge displacement of the compressor. Thus, the flow rate of the refrigerant in the refrigerant circuit is decreased, which decreases the pressure difference ΔPds.

As described above, to maintain a target value of the pressure difference ΔPd, which is determined based on the electromagnetic force F from the solenoid portion 60, the first control valve CV1 controls the position of the operation rod 40 in accordance with the variation of the pressure difference ΔPd. The target value can be changed between its minimum value, at the minimum duty ratio, and its maximum value, at the maximum duty ratio, by changing the electromagnetic force F.

Figure 5:
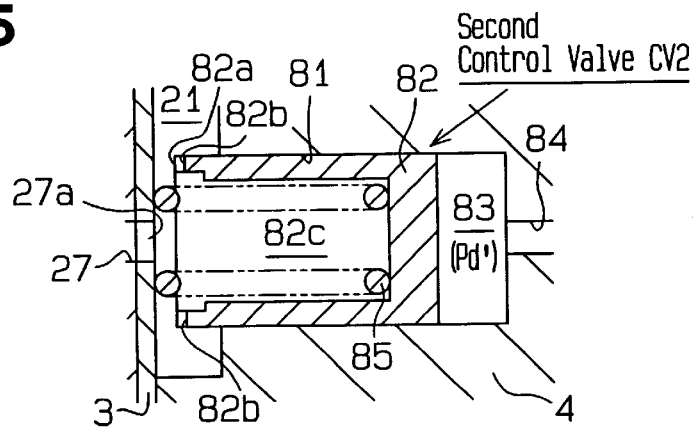
FIG. 5 is a sectional view for explaining an operation of the second control valve of FIG. 1.

As shown in FIG. 5, when a predetermined time or longer has elapsed after the engine E is stopped, the pressure in the refrigerant circuit becomes uniform at a low value. As a result, the crank pressure Pc becomes equal to the pressure Pd' in the back pressure chamber 83. Thus, the spool 82 is separated from the valve plate 3 due to the force f3 of the third spring 85, which fully opens the bleed passage 27.

In the compressor, when employed in a general vehicular air-conditioning system, if liquid refrigerant exists in a low-pressure section of the external refrigerant circuit 30 when the engine E has been stopped for a relatively long time, the liquid refrigerant may flow into the crank chamber 5 through the suction chamber 21 and the bleed passage 27. In particular, when the temperature in the passenger compartment is high and the temperature in the engine compartment, in which the compressor is disposed, is low, a large amount of liquid refrigerant may flow through the suction chamber 21 into the crank chamber 5 and stay there. Therefore, when the engine E is activated to start the compressor, the liquid refrigerant evaporates due to heat generated by the engine E and stirring by the swash plate 12. As a result, the crank pressure Pc may excessively increase, regardless of the degree of opening of the first control valve CV1.

For example, when the interior of the passenger compartment is hot and the A/C switch 73 is turned ON upon or immediately after starting the engine E, the controller 70 instructs the drive circuit 71 to supply an electric current at the maximum duty ratio so that the target value of the pressure difference for the first control valve CV1 is maximized. Thus, the first control valve CV1 completely closes the supply passage 28, so that the pressure Pd' in the pressure detection region K in the supply passage 28, i.e., the pressure Pd' in the back pressure chamber 83, is kept equal to that in the crank chamber Pc.

The third spring 85 keeps the spool 82 such that it fully opens the bleed passage 27. Therefore, the liquid refrigerant in the crank chamber 5 is rapidly discharged into the suction chamber 21 through the bleed passage 27 in a liquid or evaporated state. The crank pressure Pc is rapidly decreased in response to the first control valve CV1 being completely closed. Thus, the inclination angle of the swash plate 12 is rapidly increased to maximize the discharge displacement.

As described above, when the compressor is in operation and the first control valve CV1 is completely closed, the second control valve CV2 largely opens the bleed passage 27. Therefore, even if the amount of blow-by gas from a cylinder bore 1*a* into the crank chamber 5 becomes greater than the initial design value due to, e.g., wear and tear of the corresponding piston 20, the blow-by gas can rapidly be discharged through the bleed passage 27 into the suction chamber 21. Thus, the crank pressure Pc can be kept substantially equal to the pressure Pc in the suction chamber 21. As a result, the maximum inclination angle of the swash plate 12, i.e., the maximum discharge displacement of the compressor is maintained.

When the interior of the passenger compartment has been cooled to a certain degree by the above-described maximum discharge displacement operation of the compressor, from immediately after the air-conditioning system was started, the controller 70 changes the duty ratio, which is sent to the drive circuit 71, from the maximum value to a smaller value. Thus, the first control valve CV1 opens the supply passage 28, so that the pressure Pd' in the pressure detection region K, i.e., in the back pressure chamber 83 in the supply passage 28, becomes higher than the crank pressure Pc.

As a result, as shown in FIG. 4, the spool 82 moves toward the valve plate 3 against the force by the third spring 85 so that the interruption face 82*a* of the spool 82 contacts the valve plate 3. The bleed passage 27 is then largely restricted with the groove 82*b*. That is, the supply passage 28 is opened to increase the gas flow into the crank chamber 5 while the gas flow out of the crank chamber 5 through the bleed passage 27 is considerably decreased. Thus, the crank pressure Pc rapidly increases, and the inclination angle of the swash plate 12 rapidly decreases, which rapidly decreases the discharge displacement.

When the interior of the passenger compartment becomes cold, an occupant turns the A/C switch 73 off. When the A/C switch 73 is turned off, the controller 70 changes the duty ratio Dt, which is sent to the drive circuit 71, to zero. When the duty ratio Dt is zero, the electromagnetic force F is eliminated and the first control valve CV1 is fully opened. The second control valve CV2 then largely restricts the bleed passage 27. Thus, the crank pressure Pc increases to be almost equal to the discharge pressure Pd, and the inclination angle of the swash plate 12, i.e., the discharge displacement of the compressor, is minimized. As a result, the power loss of the engine E is lowered when cooling is riot required.

As described above, when the compressor is in operation and the first control valve CV1 is not completely closed, the second control valve CV2 largely restricts the bleed passage 27. Therefore, the leakage of compressed refrigerant gas from the discharge chamber 22 into the crank chamber 5 and the suction chamber 21 is reduced. As a result, a reduction of the refrigeration cycle efficiency, caused by re-expansion of refrigerant gas leaked to the suction chamber 21 is limited.

This embodiment has the following effects.

The displacement control mechanism includes both the first control valve CV1, which serves as an inlet-side control valve, and the second control valve CV2, which serves as a drain-side control valve. In particular, the inlet-side control valve CV1 is positively operated when changing the crank pressure Pc. Thus, the discharge displacement of the compressor is rapidly changed so that the cooling performance of the air-conditioning system is good. When the first control valve CV1 completely closes the supply passage 28, the second control valve CV2 fully opens the bleed passage 27 synchronously with the operation of the first control valve CV1. Thus, even if a large amount of liquid refrigerant remains in the crank chamber 5 when the compressor is started, the liquid refrigerant is rapidly discharged, and the discharge displacement of the compressor can be increased. This improves the initial performance of the air-conditioning system.

The fixed restrictor 39 is located in the supply passage 28 downstream of the valve seat 53 of the first control valve CV1. The pressure detection region K is provided in the supply passage 28 between the fixed restrictor 39 and the valve seat 53 of the first control valve CV1. Thus, when the first control valve CV1 opens the supply passage 28 when the supply passage 28 has been completely closed, the pressure in the pressure detection region K upstream of the fixed restrictor 39 is increased rapidly to close the second control valve CV2, thereby largely restricting the bleed passage 27. As a result, the crank pressure Pc is rapidly increased, which rapidly decreases the discharge displacement of the compressor.

Even when a predetermined time or more has elapsed after the first control valve CV1 opens the supply passage 28, the fixed restrictor 39 can maintain the pressure Pd' in the pressure detection region K, which is upstream of the fixed restrictor 39, higher than the crank pressure Pc. Thus, the second control valve CV2 continues to restrict the bleed passage 27. This effectively decreases the leakage of compressed refrigerant gas from the discharge chamber 22 into the suction chamber 21, as described above.

The target value of the pressure difference is varied by changing the duty ratio for controlling the first control valve CV1. Thus, in comparison with a control valve having no solenoid portion 60, that is, having only a pressure-sensing structure with a single target value of the pressure difference, this embodiment more accurately controls the air-conditioning.

In this embodiment, using the pressure difference ΔPd between the two pressure-monitoring points P1 and P2 in the refrigerant circuit as a target that is directly controlled, a feedback control for the discharge displacement of the compressor is accomplished. Thus, the discharge displacement is externally controlled with good response and is scarcely affected by the thermal load on the evaporator 33.

Since the second pressure-sensing member and the second valve body are united as the spool 82, the structure of the second control valve CV2 is simple.

Figure 6:
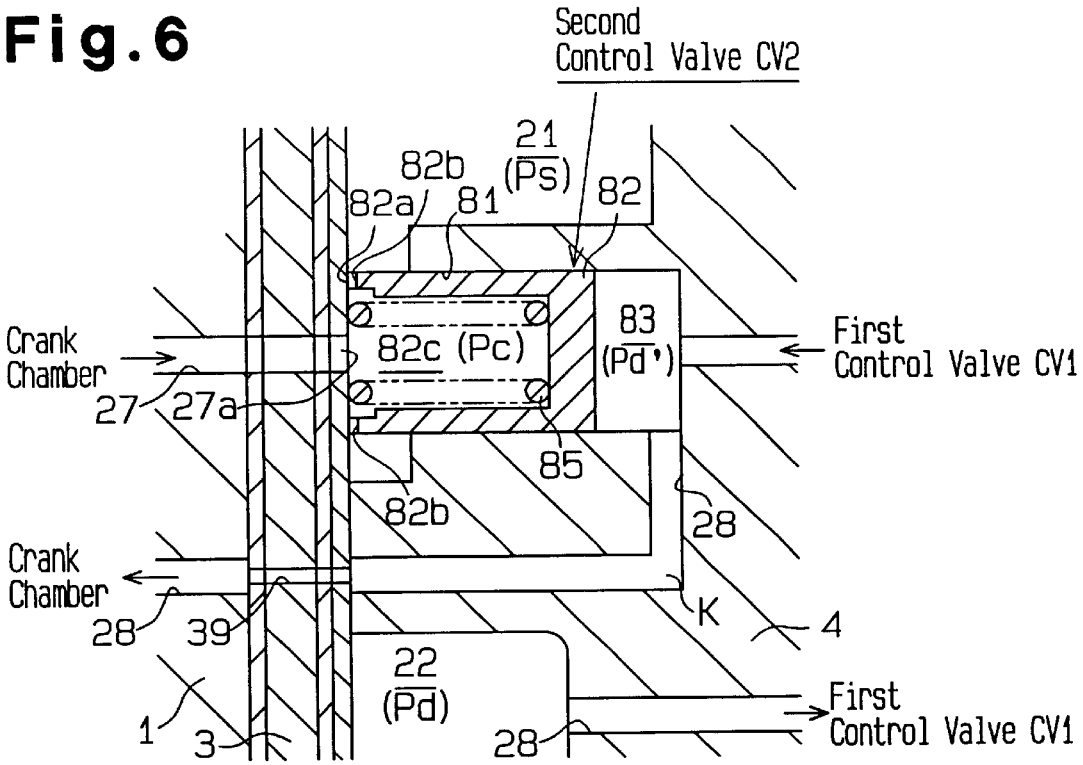
FIG. 6 is an enlarged sectional view of the vicinity of a second control valve according to a second embodiment of the present invention.

The second embodiment of the present invention shown in FIG. 6 differs from the first embodiment shown in FIGS. 1 to 5 in that the back pressure chamber 83 in the second control valve CV2 is part of the supply passage 28 (the pressure detection region K). This embodiment has the following effect in addition to the effects of the first embodiment shown in FIGS. 1 to 5. In this embodiment, the pressure detection passage 84 can be eliminated from the displacement control mechanism. Thus, in manufacturing the compressor, the difficult process of branching the pressure detection passage 84 from the supply passage 28, i.e., highly accurate machining of the fine holes, is unnecessary. This reduces of the manufacturing cost of the compressor.

Figure 7:
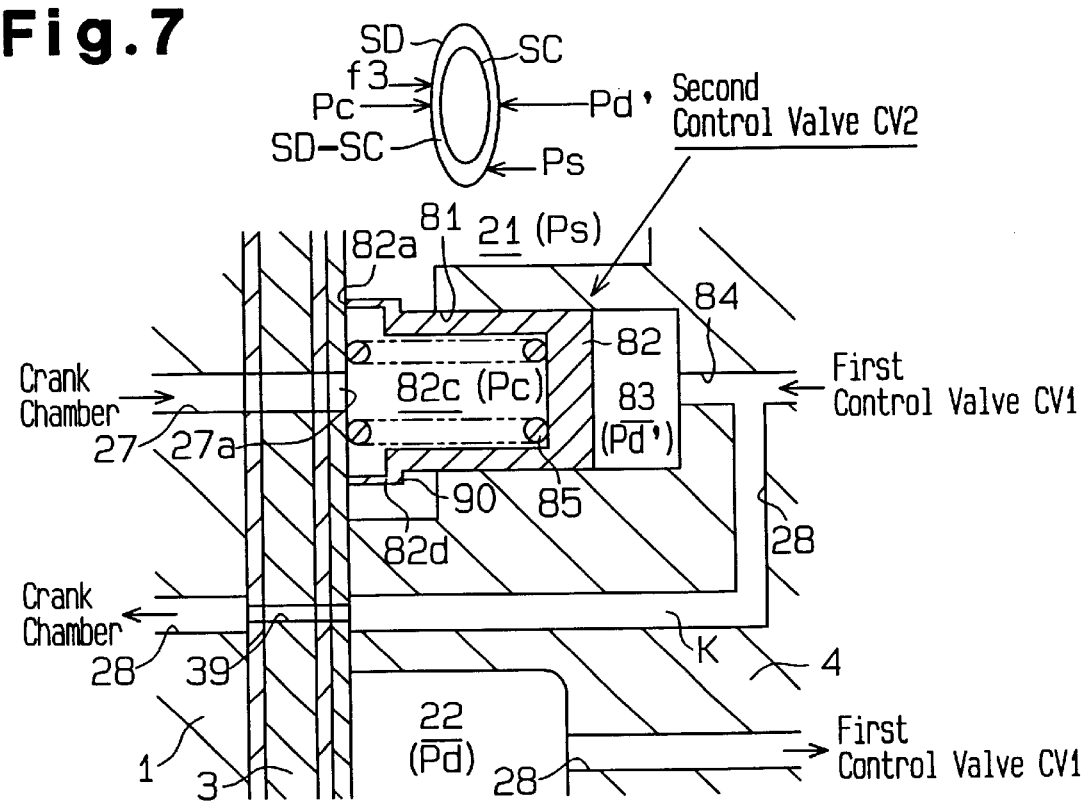
FIG. 7 is an enlarged sectional view of the vicinity of a second control valve according to a third embodiment of the present invention.

In the third embodiment of the present invention shown in FIG. 7, the groove 82*b* is eliminated from the interruption face 82*a* of the spool 82 shown in FIG. 4. The distal end of the spool 82 is formed into a large-diameter portion 82*d* as shown in FIG. 7. The cross-sectional area of the interruption face 82*a*, i.e., the effective pressure-receiving area SD for receiving the crank pressure Pc, is larger than the effective pressure-receiving area SC for the pressure Pd' in the back pressure chamber 83. A suction pressure Ps acts on the step face 90 of the large-diameter portion 82*d* in the direction, in which the interruption face 82*a* contacts the valve plate 3, i.e., the direction in which the valve is closed.

Therefore, the position of the spool 82 relative to the valve plate 3 is determined in accordance with the balance between a force SD·Pc based on the crank pressure Pc and the force f3 by the third spring 85, which are rightward forces in FIG. 7, and a force SC·Pd' based on the pressure Pd' in the back pressure chamber 83 and a force (SD−SC)Ps based on the suction pressure Ps, which are leftward forces in FIG. 7.

When the interruption face 82*a* of the spool 82 is in contact with the valve plate 3, the bleed passage 27 is fully closed. Therefore, in comparison with the embodiment of FIG. 4, which has the groove 82*b* and in which gas can properly be drained from the crank chamber 5 even when the spool 82 is in contact with the valve plate 3, the crank pressure Pc is apt to increase excessively only by controlling the degree of opening the first control valve CV1. If the crank pressure Pc excessively increases, the discharge displacement of the compressor excessively decreases and the first control valve CV1 may fully close the supply passage 28 to largely decrease the crank pressure Pc. Thus, the second control valve CV2 fully opens the bleed passage 27, and the crank pressure Pc may be excessively decreased. Due to such cyclic behavior, the crank pressure Pc, i.e., the discharge displacement of the compressor, does not stabilize. This impairs the cooling performance of the air-conditioning system.

In this embodiment, however, the effective pressure-receiving area SD for receiving the crank pressure Pc in the bleed passage 27 is larger than the effective pressure-receiving area SC for receiving the pressure Pd' in the back pressure chamber 83. Thus, even when the crank pressure Pc is lower than the pressure Pd' in the back pressure chamber 83, if the crank pressure Pc is going to increase excessively, more specifically, the rightward pressing force SD·Pc+f3 in FIG. 7 exceeds the leftward pressing force SC−Pd'+(SD−SC)Ps, the spool 82 can be moved from the position at which the bleed passage 27 is closed to the position at which the bleed passage 27 is fully open. As a result, the bleed passage 27 is opened to prevent an excessive increase in the crank pressure Pc. Thus, even if the degree of opening of the first control valve CV1 is rapidly increased, the crank pressure Pc, i.e., the discharge displacement of the compressor rapidly stabilizes, which improves the cooling performance of the air-conditioning system.

Figure 8:
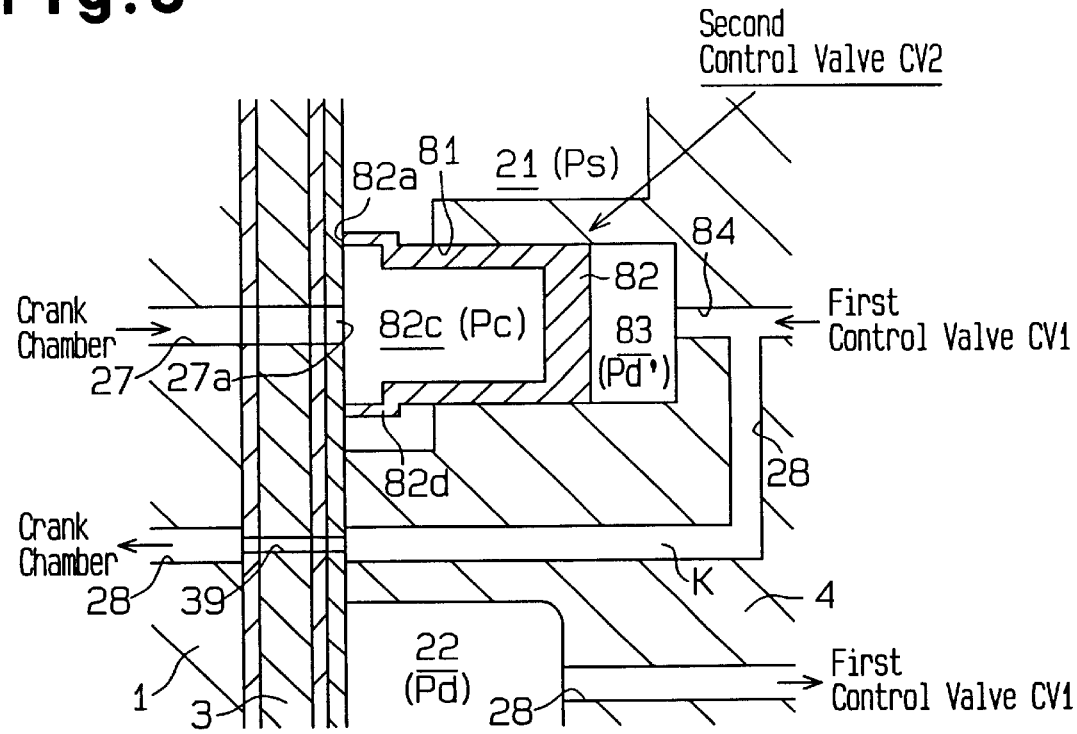
FIG. 8 is an enlarged sectional view of the vicinity of a second control valve according to a fourth embodiment of the present invention.

The fourth embodiment of the present invention shown in FIG. 8 differs from the embodiment of FIG. 7 in that the third spring 85 is eliminated from the second control valve CV2.

More specifically, in the spool 82 of the embodiment of FIG. 7, the effective pressure-receiving area SD for receiving the crank pressure Pc in the bleed passage 27 is larger than the effective pressure-receiving area SC for receiving the pressure Pd' in the back pressure chamber 83. Thus, even if the first control valve CV1 completely closes the supply passage 28 and the crank pressure Pc is equal to the pressure Pd' in the back pressure chamber 83, the rightward force in FIG. 7 acting on the spool 82 exceeds the leftward force by (Pc−Ps)×(SD−SC).

In this embodiment, therefore, even when the second control valve CV2 does not have the third spring 85 (the force f3), when the first control valve CV1 changes from a state of opening the supply passage 28 to a state of completely closing the supply passage 28 can surely the spool 82 separates from the valve plate 3 to change the bleed passage 27 from a completely closed state to a fully opened state. Thus, the function of the third spring 85 is performed by using the crank pressure Pc and the suction pressure Ps. In this embodiment, in which the third spring 85 is not employed, the number of parts of the compressor is reduced.

Figure 9:
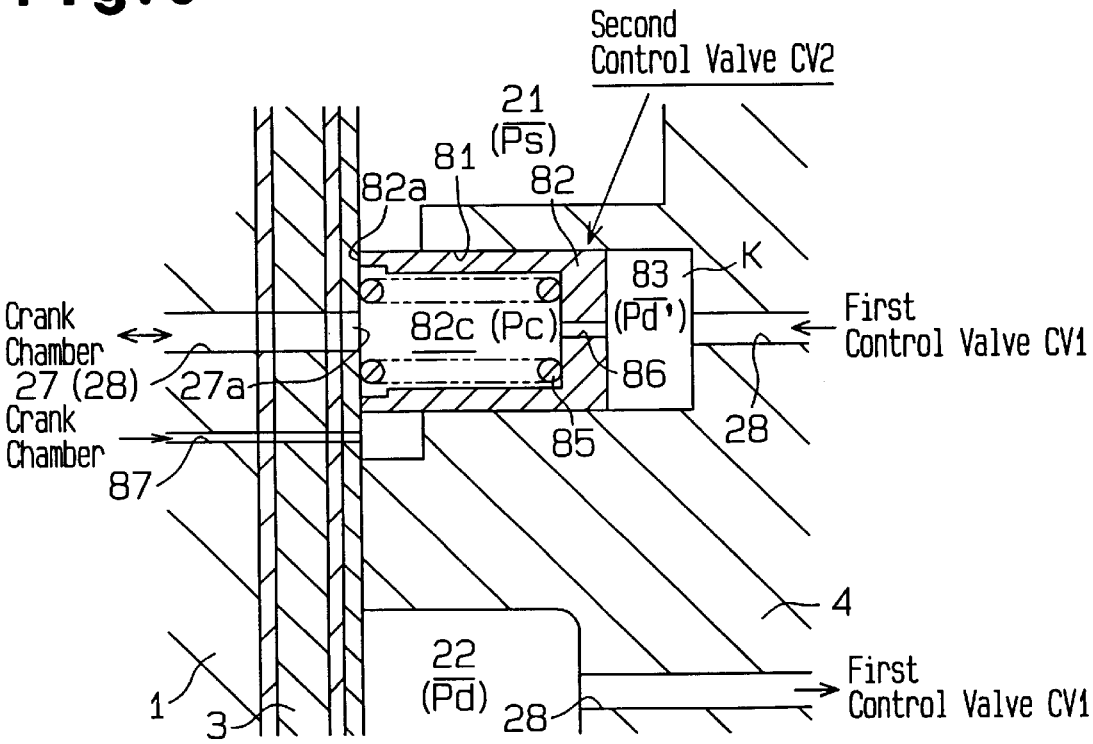
FIG. 9 is an enlarged sectional view of the vicinity of a second control valve according to a fifth embodiment of the present invention.

In the fifth embodiment of the present invention shown in FIG. 9, the downstream portion of the supply passage 28 between the back pressure chamber 83 of the second control valve 82 and the crank chamber 5 is eliminated. A communication passage 86 for connecting the back pressure chamber 83 with the space 82*c* is formed in the bottom wall of the spool 82. The crank chamber 5 always communicates with the suction chamber 21 through a second bleed passage 87 as a pressure passage. The groove 82*b* is eliminated from the interruption face 82*a* of the spool 82.

In the second control valve CV2, the pressure Pd' becomes equal to the pressure of the crank chamber Pc when the first control valve CV1 completely closes the supply passage 28. The spool 82 then fully opens the bleed passage 27 because of the force f3 by the third spring 85. Introducing refrigerant gas through the bleed passage 27 and the second bleed passage 87 decreases the crank pressure Pc.

When the first control valve CV1 opens the supply passage 28, the pressure Pd' in the back pressure chamber 83 increases and the spool 82 contacts the valve plate 3 to completely close the bleed passage 27. Thus, the increase in the pressure in the back pressure chamber 82 is transmitted to the crank chamber 5 through the communication passage 86, the space 82*c*, and the bleed passage 27, thereby increasing the crank pressure Pc. That is, when the second control valve CV2 is completely closed, the back pressure chamber 82, the communication passage 86, the space 82*c*, and the bleed passage 27 serve as part of the supply passage 28.

In the second control valve CV2, the communication passage 86, which serves as part of the supply passage 28, is smaller in cross section than either of the preceding and succeeding sections of the supply passage 28. Thus, the communication passage 86 serves as the fixed restrictor 39 in the supply passage 28. That is, the back pressure chamber 83 of the second control valve CV2 is in the pressure detection region K in the supply passage 28, like the second embodiment shown in FIG. 6.

This embodiment has the following effects in addition to the above-described effects of the second embodiment.

When the second control valve CV2 is completely closed, the back pressure chamber 82, the communication passage 86, the space 82*c*, and the bleed passage 27 serve as part of the supply passage 28. Thus, since the pressure detection region K portion as shown in FIG. 6 need not be formed in the rear housing 4, the step of forming this portion can be eliminated, which reduces the manufacturing cost of the compressor.

The crank chamber 5 is always open to the suction chamber 21 through the second bleed passage 87. Thus, even when the first control valve CV1 opens the supply passage 28 and the second control valve CV2 is completely closed, gas can be introduced from the crank chamber 5 into the suction chamber 21 through the second bleed passage 87. As a result, a refrigerant gas flow from the discharge chamber 22 into the suction chamber 21 occur through the supply passage 28, the back pressure chamber 83, the communication passage 86, the space 82*c*, the bleed passage 27, the crank chamber 5, and the second bleed passage 87. Thus, the interior of the crank chamber 5 can be fully cooled by the flow of the refrigerant gas at a relatively low temperature. Furthermore, the deterioration of the sliding surfaces (e.g., between the shoe 19 and the swash plate 12), which is caused by temperature rising in the crank chamber 5, is reduced.

Figure 10:
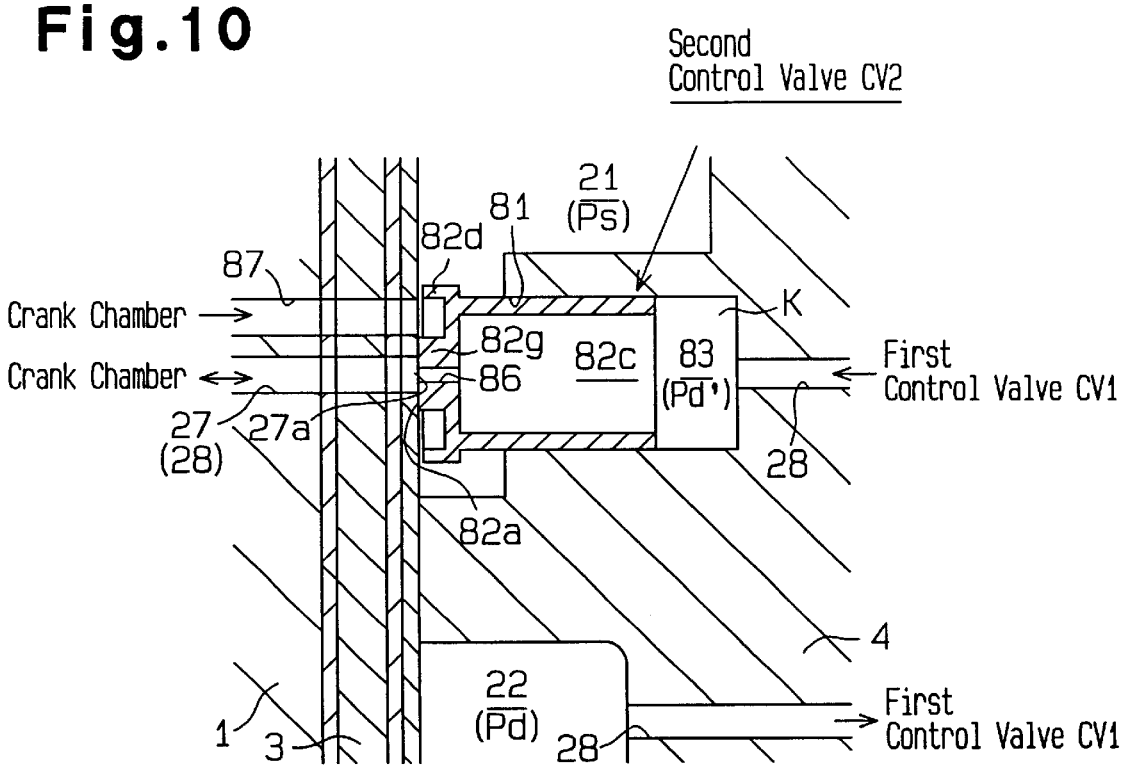
FIG. 10 is an enlarged sectional view of the vicinity of a second control valve according to a sixth embodiment of the present invention.

The sixth embodiment of the present invention shown in FIG. 10 differs from the embodiment of FIG. 9 in that the space 82*c* of the spool 82 is part of the back pressure chamber 83 and the communication passage 86 is formed on the valve plate 3 side.

The large-diameter portion 82*c* is formed in the front end portion of the spool 82 on the valve plate 3 side. From the view of the function of the large-diameter portion 82*d* corresponding to the function of the third spring 85 (for restoring the spool 82 from the closed position to the fully open position), the third spring 85 is eliminated from the second control valve CV2. Substantially at the center of the large-diameter portion 82*d*, a valve portion 82*g* that can control the degree of opening the bleed passage 27 is provided at the position corresponding to the opening 27*a* of the bleed passage 27. The valve portion 82*g* is formed at the same level as the large-diameter portion 82*d* toward the valve plate 3 or to protrude beyond the large-diameter portion 82*d* by several tens of $\mu$m.

The opening portion 27*a* of the second bleed passage 87 is opposed to the valve portion 82*g* of the spool 82. That is, like the embodiment of FIG. 8, to obtain the function of the third spring 85, the crank pressure Pc must act on the entire surface of the front end portion of the spool 82. In this embodiment, the crank pressure Pc through the second bleed passage 87 is directly applied to a portion radially outward of than the interruption face 82*a*. Furthermore, the gap between the large-diameter portion 82*d* and the valve plate 3 is set to be narrow. Thus, the radially outer portion can be under the influence of the crank pressure Pc.

In this embodiment, the spool 82 is reversed in the right and left directions to that of the embodiment shown in FIG. 9. Thus, the communication passage 86 can be open directly in the same plane as the interruption face 82*a*. In this embodiment, when the first control valve CV1 opens the supply passage 28 and the spool 82 contacts the valve plate 3, the flow of the refrigerant gas through the opening portion 27*a* into the bleed passage 27 is restricted by the communication passage 86.

Thus, the flow of the refrigerant gas from the back pressure chamber 83 of the spool 82 into the supply passage 28 (or the bleed passage 27) is accelerated, and the refrigerant gas can be sent through the supply passage 28 (the bleed passage 27) into the crank chamber 5 by the accelerated flow. That is, more refrigerant gas can be introduced from the discharge chamber 22 into the suction chamber 21 through the supply passage 28, the back pressure chamber 83, the communication passage 86, the bleed passage 27, the crank chamber 5, and the second bleed passage 87. Thus, the interior of the crank chamber 5 can be fully cooled by the flow of the refrigerant gas, which has a relatively low temperature. Furthermore, deterioration of the sliding surfaces (e.g., between the shoe 19 and the swash plate 12), which is caused by high temperatures in the crank chamber 5, is limited.

Figure 11:
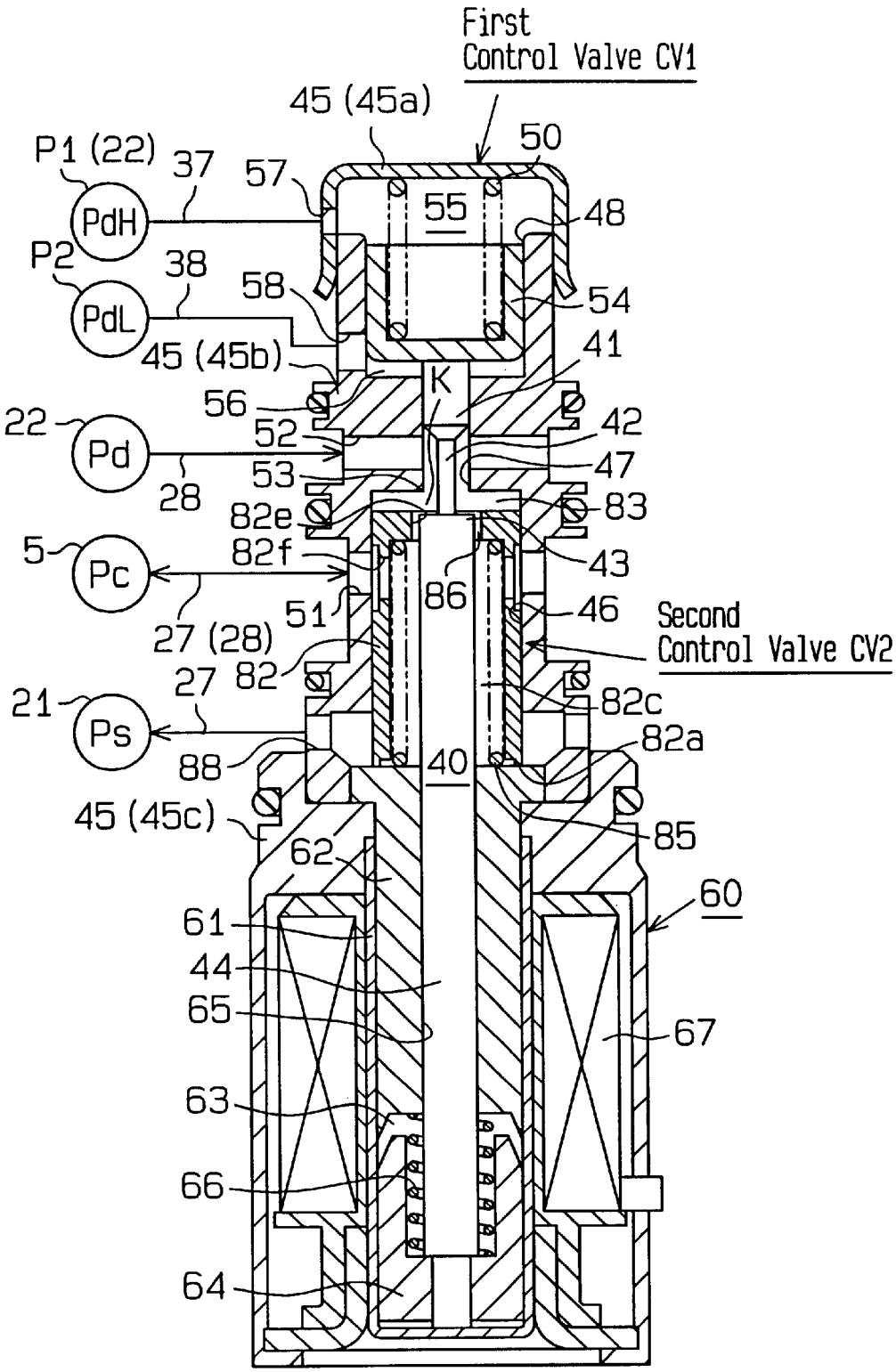
FIG. 11 is a sectional view of a first control valve with a second control valve incorporated therein according to a seventh embodiment of the present invention.
Figure 12:
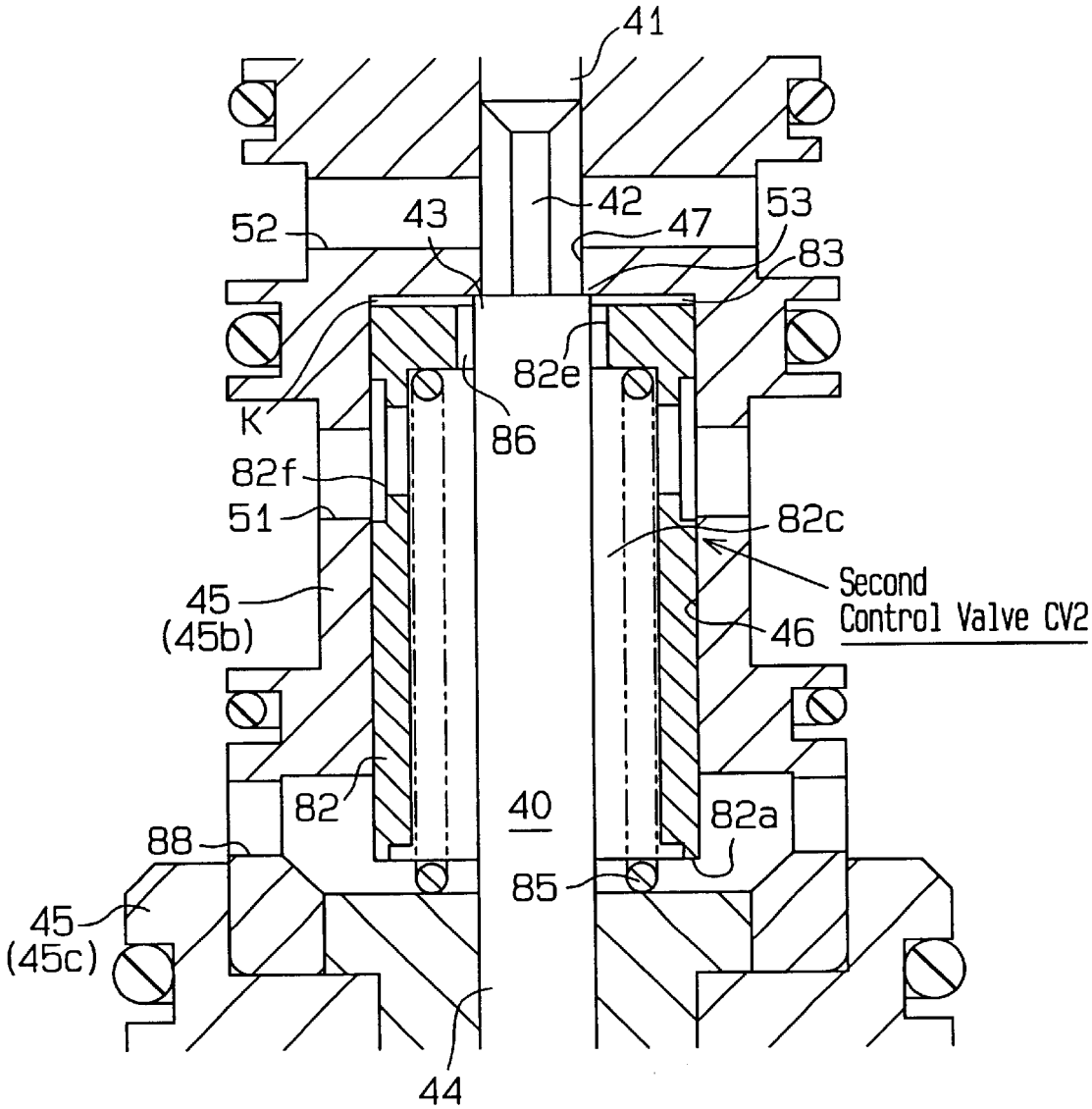
FIG. 12 is an enlarged sectional view for explaining an operation of the second control valve of FIG. 11.

The seventh embodiment of the present invention shown in FIGS. 11 and 12 differs from the embodiment shown in FIG. 9 in that the second control valve CV2 is incorporated in the valve housing 45 of the first control valve CV1. In the first control valve CV1 of this embodiment, the flow directions between the ports 51 and 52 is reversed with respect to that in the first control valve CV1 shown in FIG. 3. That is, the upstream side of the supply passage 28 is connected to the port 52 and the upstream side of the bleed passage 27, which serves as a downstream portion of the supply passage 28, is connected to the port 51.

A bottomed cylindrical spool 82 is fitted in the valve chamber 46 of the first control valve CV1 so that the spool 82 can slide in the axial direction of the valve housing 45. That is, the valve chamber 46 serves as a support for the spool 82. In the top wall of the spool 82, a hole 82*e* is formed through which the operation rod 40 is fitted. In the uppermost portion of the valve chamber 46, a back pressure chamber 83 is defined by the valve housing 45 and the upper end face of the spool 82.

The back pressure chamber 83 communicates with the space 82*c* in the spool 82 through the gap between the spool 82 and the operation rod 40 in the hole 82*e*. A communication hole 82*f* is formed through a side wall portion of the spool 82. The back pressure chamber 83 communicates with the port 51 through the space 82*c* in the spool 82 and the communication hole 82*f*.

A radial port 88 is provided in the circumferential wall of the valve housing 45 surrounding the lowermost portion of the valve chamber 46. The port 88 is provided for connecting the valve chamber 46 with the suction chamber 21 through a downstream portion of the bleed passage 27. The port 88 communicates with the valve chamber 46 (the space 82*c* in the spool 82) through a gap between the interruption face 82*a* of the spool 82 and the upper end face of the fixed iron core 62.

The communication passage 86 formed by the gap between the spool 82 and the operation rod 40 in the hole 82*e* is smaller in cross section than either of the preceding and succeeding flow passage sections. The communication passage 86 of this embodiment has the same function as the communication passage 86 of the embodiment of FIG. 9 and the fixed restrictor 39 of the embodiment of FIG. 4. Thus, the back pressure chamber 83 located between the communication passage 86 and the valve seat 53 of the first control valve CV1 serves as the pressure detection region K.

As shown in FIG. 11, when the valve body portion 43 of the operation rod 40 opens the communication passage 47, the force of the pressure Pd' in the back pressure chamber 83 exceeds force of the crank pressure Pc in the space 82*c* and the force f3 by the third spring 85. The spool 82 is thus moved downward so that its interruption face 82*a* contacts the upper end face of the fixed iron core 62. Thus, communication between the port 88 and the valve chamber 46 is interrupted, and the portion of the bleed passage 27 upstream of the valve seat 53 of the second control valve CV2 serves as part of the supply passage 28.

As shown in FIG. 12, when the valve body portion 43 of the operation rod 40 closes the communication passage 47, the pressure Pd' in the back pressure chamber 83 becomes almost equal to the crank pressure Pc. As a result, the force f3 by the third spring 85 separates the interruption face 82*a* of the spool 82 from the upper end face of the fixed iron core 62. Thus, the port 88 communicates with the valve chamber 46, which opens the bleed passage 27. The refrigerant gas in the crank chamber 5 then flows into the suction chamber 21 through the bleed passage 27.

This embodiment has the following effect in addition to the effects of the embodiment shown in FIG. 9. Since the first and second control valves CV1 and CV2 are united in the valve housing 45, the work of installing up the first and second control valves CV1 and CV2 in the rear housing 4 is simplified in manufacturing the compressor.

Figure 13:
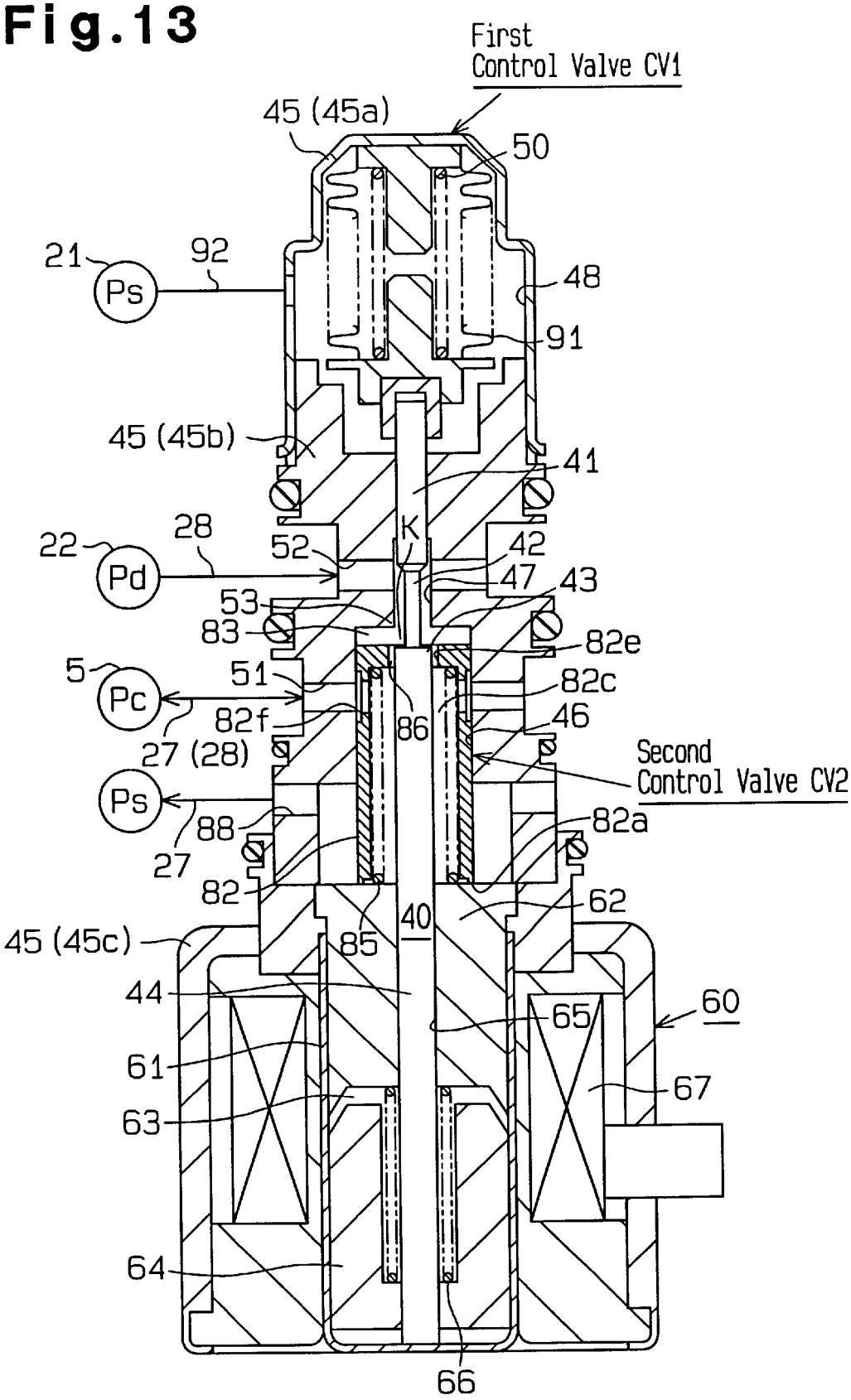
FIG. 13 is a sectional view of a first control valve with a second control valve incorporated therein according to an eighth embodiment of the present invention.

The eighth embodiment of the present invention shown in FIG. 13 differs from the embodiment of FIGS. 11 and 12 in the pressure-sensing structure of the first control valve CV1.

The pressure-sensing chamber 48 accommodates a bellows 91 as a first pressure-sensing member. The bellows 91 is connected with the distal end portion 41 of the operation rod 40. The pressure-sensing chamber 48 is connected with the suction chamber 21 through a pressure detection passage 92. A suction pressure Ps is introduced into the pressure-sensing chamber 48 through the pressure detection passage 92. Thus, expansion and contraction of the bellows 91 caused by the variation of the suction pressure Ps is reflected on the positioning of the valve body portion 43 of the operation rod 40.

For example, as the suction pressure Ps decreases, the bellows 91 is expanded, and then the operation rod 40 is moved downward to increase the degree of opening of the communication passage 47. Thus, the crank pressure Pc is increased, which decreases the discharge displacement of the compressor and increases the suction pressure Ps. Conversely, as the suction pressure Ps increases, the bellows 91 is contracted. The operation rod 40 is then moved upward, which decreases the degree of opening of the communication passage 47. Thus, the crank pressure Pc is decreased, which increases the discharge displacement of the compressor and decreases the suction pressure Ps.

That is, to maintain a target value of the suction pressure Ps, which is determined in accordance with the electromagnetic force F from the solenoid portion 60, the first control valve CV1 automatically positions the operation rod 40 internally in accordance with the variation of the suction pressure Ps. The target value of the suction pressure Ps is varied by changing the electromagnetic force F.

This embodiment has the following effect in addition to the effects of the embodiment shown in FIGS. 11 and 12. The first control valve CV1 feedback controls the discharge displacement of the compressor using, as a control index, the absolute value of the suction pressure Ps, which reflects the cooling load. Thus, the discharge displacement is controlled to correspond to the cooling load.

The present invention may include the following modifications.

Figure 14:
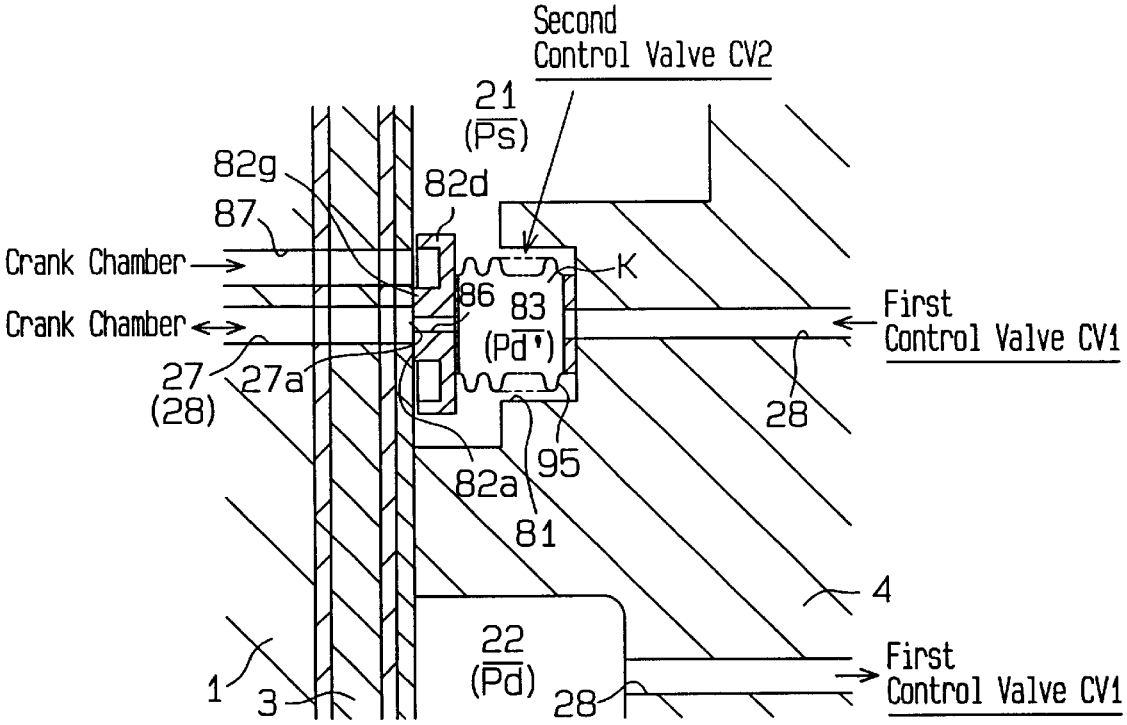
FIG. 14 is an enlarged sectional view of the vicinity of a second control valve according to a ninth embodiment of the present invention.

As in the ninth embodiment of the present invention shown in FIG. 14, the part of the spool 82 for the valve body function, for example, in the embodiment of FIG. 10, may be supported in the rear housing 4 with a bellows 95 between them. In this case, the space between the bellows 95 and the rear housing 4 serves as the back pressure chamber 83. This construction can prevent a situation where the spool 82 cannot move smoothly because of a foreign substance caught between the outer circumferential surface of the spool 82 and the inner circumferential surface of the accommodation chamber 81. A diaphragm may be substituted for the bellows 95.

In each of the embodiments of FIGS. 1 to 13, the relationship between the spool 82 and the accommodation chamber 81 or valve chamber 46 is nor limited to a convex spool 82 and a concave accommodation chamber 81 or valve chamber 46. The reverse relationship, in which the spool 82 is concave and the accommodation chamber 81 or valve chamber 46 side is convex is also possible.

Figure 15:
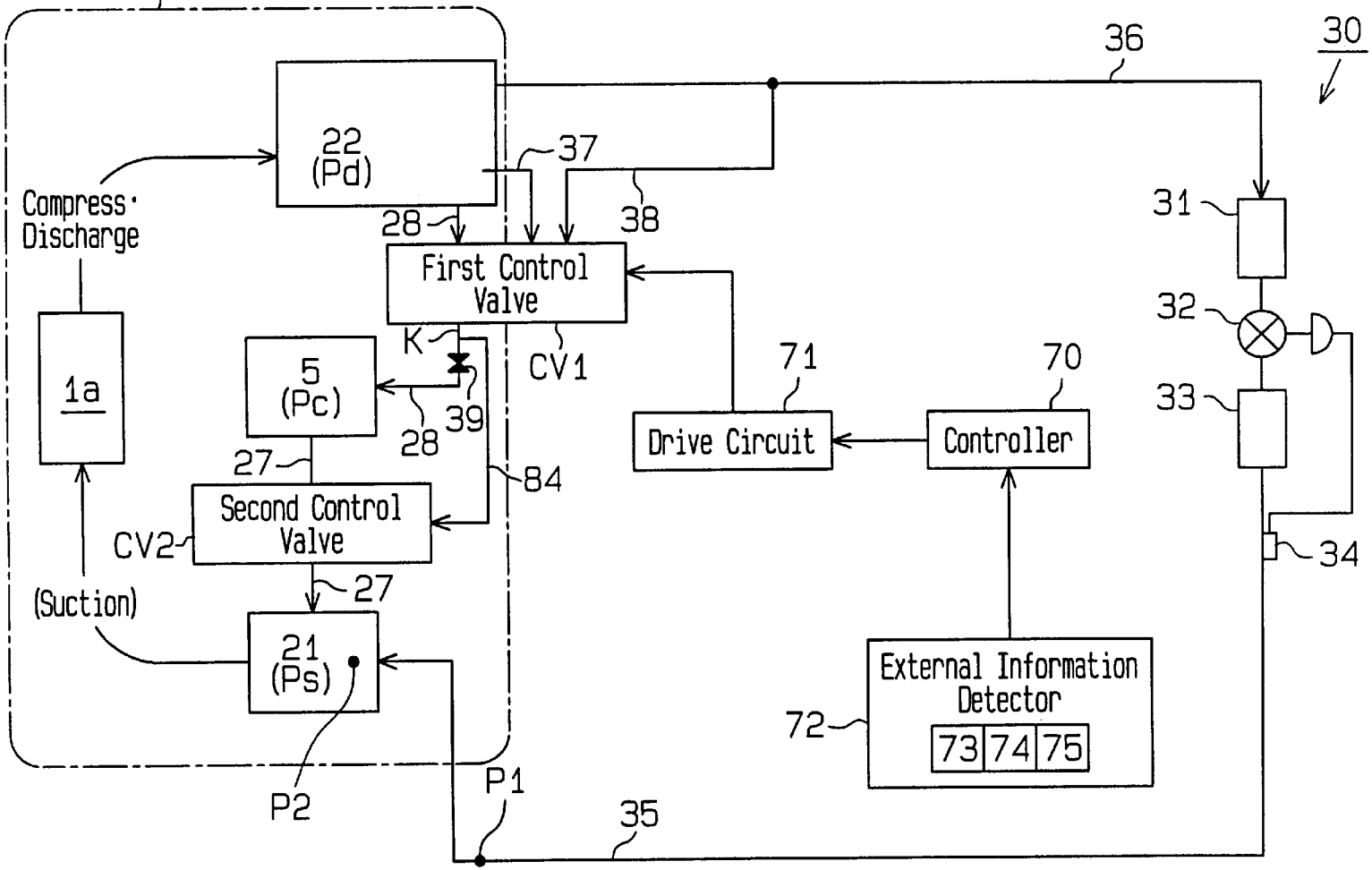
FIG. 15 is a circuit diagram showing an outline of a refrigerant circuit according to a tenth embodiment of the present invention.

As in the tenth embodiment shown in FIG. 15, the first pressure-monitoring point P1 may be between the evaporator 33 and the suction chamber 21 in the suction pressure region (in FIG. 15, in the conducting pipe 35) and the second pressure-monitoring point P2 may be downstream of the first pressure-monitoring point P1 in the same suction pressure region (in FIG. 15, within the suction chamber 21).

The first pressure-monitoring point P1 may be between the discharge chamber 22 and the condenser 31 in the discharge pressure region, and the second pressure-monitoring point P2 may be between the evaporator 33 and the suction chamber 21 in the suction pressure region.

The first pressure-sensing member of the first control valve CV1 move according to the absolute value of the discharge pressure Pd. In other words, the first control valve CV1 may automatically position the operation rod 40 internally in accordance with variation of the discharge pressure Pd to maintain a target value of the discharge pressure Pd, which is determined in accordance with the electromagnetic force F of the solenoid portion 60.

The first control valve CV1 is a drain-side control valve for controlling the degree of opening of the bleed passage 27 and the second control valve CV2 may be an inlet-side control valve for controlling the degree of opening of the supply passage 28.

The present invention can be applied also to displacement control mechanisms for variable displacement type wobble compressors.

A power transmission mechanism PT with a clutch mechanism such as an electromagnetic clutch may be used.

It should be apparent to those skilled in the art that the present invention may be embodied in many other specific forms without departing from the spirit or scope of the invention. Particularly, it should be understood that the invention may be embodied in the following forms.

Therefore, the present examples and embodiments are to be considered as illustrative and not restrictive and the invention is not to be limited to the details given herein, but may be modified within the scope and equivalence of the appended claims.

What is claimed is:

1. A displacement control mechanism used for a variable displacement type compressor, the displacement of which varies in accordance with the pressure of a crank chamber, wherein the control mechanism is installed in a refrigerant circuit, wherein the refrigerant circuit includes a suction pressure zone and a discharge pressure zone, and the compressor has a bleed passage, which connects the crank chamber to the suction pressure zone, and a supply passage, which connects the crank chamber to the discharge pressure zone, wherein one of the bleed passage and the supply passage is a control passage and the other is a regulating passage, the displacement control mechanism comprising:

a first control valve, the first control valve comprising:

a first valve body for adjusting the opening size of the control passage;

a pressure sensitive member that moves in accordance with a pressure in the refrigerant circuit such that the displacement is varied to counter changes of the pressure in the refrigerant circuit;

a pressure detection region located in the control passage, wherein the pressure detection region is located downstream of the first valve body;

a second control valve, wherein the second control valve includes a second valve body for adjusting the opening size of the regulating passage, wherein the second valve body moves in accordance with the pressure of the pressure detection region, wherein, when the pressure of the pressure detection region increases, the second control valve decreases the opening size of the regulating passage.

2. The displacement control mechanism according to claim 1, wherein a fixed restrictor is located a downstream of the first valve body, wherein the pressure detection region is between the first valve body and the fixed restrictor.

3. The displacement control mechanism according to claim 1, wherein the control passage is the supply passage, wherein the regulating passage is the bleed passage.

4. The displacement control mechanism according to claim 3, wherein a force based on the pressure of the pressure detection region acts in a direction to close the control passage, wherein a force based on the pressure of the bleed passage acts in a direction to open the regulating passage, wherein an opening size of the second control valve is controlled in accordance with the pressure difference between the pressure of the pressure detection region and the pressure of the bleed passage.

5. The displacement control mechanism according to claim 4, wherein the second valve body has a first effective pressure receiving area, which receives the pressure of the pressure detection region, and a second effective pressure receiving area, which receives the pressure of the bleed passage, and the first effective pressure receiving area is greater than the second effective pressure receiving area.

6. The displacement control mechanism according to claim 4, wherein the second control valve comprises:

a valve housing;

an accommodating chamber located in the valve housing, wherein the second pressure sensitive member is a movable spool fitted in the accommodating chamber;

a back pressure chamber defined between the accommodating chamber and the spool, wherein the pressure of the pressure detection region is applied to the back pressure chamber, wherein the spool moves based on the pressure difference between the pressure of the back pressure chamber and the pressure of the bleed passage, wherein the opening size of the bleed passage is adjusted in accordance with the movement of the spool.

7. The displacement control mechanism according to claim 6, wherein a communication passage is formed in the spool, wherein the communication passage connects the back pressure chamber to the regulating passage.

8. The displacement control mechanism according to claim 7, wherein a pressure passage connects the crank chamber to the suction pressure zone.

9. The displacement control mechanism according to claim 1, wherein the first control valve and the second control valve are located in a single valve housing.

10. The displacement control mechanism according to claim 1, wherein the first control valve has an actuator, wherein the actuator varies the force that applies to the pressure sensitive member in accordance with an external command.

11. The displacement control mechanism according to claim 10, wherein the actuator is a solenoid, wherein the solenoid varies force in accordance with a supplied electrical current.

12. The displacement control mechanism according to claim 1, wherein the pressure sensitive member moves in accordance with the pressure difference between two pressure monitoring points in which are located in the refrigerant circuit.

13. The displacement control mechanism according to claim 1, wherein the sensitive pressure member moves in accordance with the pressure of the suction pressure zone.

* * * * *

UNITED STATES PATENT AND TRADEMARK OFFICE

CERTIFICATE OF CORRECTION

PATENT NO. : 6,517,323 B2
DATED : February 11, 2003
INVENTOR(S) : Kazuya Kimura et al.

It is certified that error appears in the above-identified patent and that said Letters Patent is hereby corrected as shown below:

Column 14,
Line 51, please delete "82*c*" and insert therefore -- 82*d* --

Signed and Sealed this

Twenty-second Day of April, 2003

JAMES E. ROGAN
*Director of the United States Patent and Trademark Office*